US006863707B2

(12) United States Patent
Lee et al.

(10) Patent No.: US 6,863,707 B2
(45) Date of Patent: Mar. 8, 2005

(54) METHOD OF FORMING TUNGSTEN-COATED W—CU COMPOSITE POWDER

(75) Inventors: Seong Lee, Daejeon (KR); Moon-Hee Hong, Seoul (KR); Joon-Woong Noh, Daejeon (KR); Eun-Pyo Kim, Daejeon (KR); Hung-Sub Song, Daejeon (KR); Woon-Hyung Baek, Daejeon (KR)

(73) Assignee: Agency for Defense Development, Daejeon (KR)

( * ) Notice: Subject to any disclaimer, the term of this patent is extended or adjusted under 35 U.S.C. 154(b) by 10 days.

(21) Appl. No.: 10/430,067

(22) Filed: May 6, 2003

(65) Prior Publication Data

US 2003/0205108 A1 Nov. 6, 2003

(30) Foreign Application Priority Data

May 6, 2002 (KR) ..... 10-2002-0024858

(51) Int. Cl.[7] ..... B22F 9/04
(52) U.S. Cl. ..... 75/352; 75/359
(58) Field of Search ..... 75/352, 359

(56) References Cited

U.S. PATENT DOCUMENTS 6,103,392 A * 8/2000 Dorfman et al. ..... 428/570
2002/0068005 A1 * 6/2002 Meinhardt et al. ..... 419/65

FOREIGN PATENT DOCUMENTS

JP 44-019016 8/1969
JP 10-060553 3/1998
JP 2001-234201 8/2001
RU 2003436 C1 * 11/1993

* cited by examiner

*Primary Examiner*—George Wyszomierski
(74) *Attorney, Agent, or Firm*—Scully, Scott, Murphy & Presser

(57) ABSTRACT

Disclosed is a method of forming a W—Cu composite powder having a Cu particle surrounded by tungsten by mixing and pulverizing tungsten oxide powder and copper oxide powder using turbular mixing or ball milling, reducing the Cu powder firstly at 200~400° C. under a hydrogen atmosphere or a reducing gas environment including hydrogen, generating W nuclei on the reduced Cu powder at 500~700° C., and growing the generated W nuclei at 750~1080° C. as well as a use of the same for the use of powder injection molding.

3 Claims, 8 Drawing Sheets

METHOD OF FORMING TUNGSTEN-COATED W— CU COMPOSITE POWDER

BACKGROUND OF THE INVENTION

1. Field of the Invention

The present invention relates to a method of forming a tungsten-coated W—Cu composite powder using a tungsten oxide ($WO_3$ and $WO_{2.9}$) powder and a copper oxide (CuO and $Cu_2O$) powder and a use of the same, and more particularly, to a method of forming a W—Cu composite powder, which has a structure that tungsten grains surround a copper particle, by mixing and pulverizing tungsten oxide powder and copper oxide powder using turbular mixing or ball milling, reducing the Cu particle firstly at 200~400° C. under a hydrogen atmosphere or a reducing gas environment including hydrogen, generating W nuclei on the reduced Cu powder at 500~700° C., and growing the generated W nuclei at 750~1080° C. as well as a use of the same for the use of powder injection molding.

2. Background of the Related Art

A method of forming a tungsten-coated W—Cu composite powder according to the related art includes the steps of reacting APT (ammonium paratungstate) or AMT (ammonium metatungstate) with CuO or CuOH just to form an intermediate product having a composition of $CuWO_4$, mixing the $CuWO_4$ with a tungsten oxide ($WO_3$) powder with a proper ratio, and carrying out reduction thereon under a hydrogen atmosphere (U.S. Pat. No. 5,956,560). Yet, such a method essentially needs the step of forming the intermediate product of $CuWO_4$.

And, Korean Patent No. 10-115587 discloses the steps of pulverizing and mixing tungsten oxide ($WO_3$ or $WO_{2.9}$) with copper oxide (CuO) uniformly by high energy ball milling and carrying out 2-step reduction thereon under a hydrogen atmosphere just to form a ultra-fine W—Cu composite powder. In the W—Cu composite powder formed by such a method, Cu and W are mixed independently with each other so as to be unsuitable for compacting as well as used as a powder for powder injection molding.

Many efforts have been made to overcome the problems of the related art, whereby a 3-step thermal reduction treatment is introduced just to develop a method of directly forming a tungsten-coated copper powder, i.e. a W—Cu composite powder, which has a structure that tungsten grains surround a copper particle, from a tungsten oxide powder and a copper oxide powder. A W—Cu composite powder where a Cu particle is surrounded by tungsten grains according to the present invention has a proper size as well as a round shape, thereby having a powder-feeding characteristic better than that of the related art. Therefore, compared to the method of the related art, the method according to the present invention provides excellent characteristics of compacting and powder injection molding.

SUMMARY OF THE INVENTION

Accordingly, the present invention is directed to a method of forming a W—Cu composite powder that substantially obviates one or more problems due to limitations and disadvantages of the related art.

An object of the present invention is to provide a method of forming a W—Cu composite powder without forming an intermediate such as $CuWO_4$ or the like.

Another object of the present invention is to provide a method of forming a W—Cu composite powder having a structure that tungsten grains surround a copper particle.

A further object of the present invention is to provide a use of a tungsten-coated W—Cu composite powder for powder injection molding.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of forming a tungsten-coated W—Cu composite powder according to the present invention includes the steps of mixing and pulverizing a tungsten oxide ($WO_3$ or $WO_{2.9}$) powder and a copper oxide (CuO or $Cu_2O$) powder using turbular mixing or ball milling and carrying out thermal reduction treatment on the mixed-pulverized oxide powders under a hydrogen atmosphere or a reducing gas environment including hydrogen.

In this case, a weight ratio between W and Cu in the W—Cu composite powder can be 10:90~90:10.

Preferably, the mixing/pulverizing step is carried out by the turbular mixing or ball milling for 1 minute~50 hours.

Preferably, the thermal reduction treatment step is carried out by being maintained for one minute~five hours at 200~400° C., being maintained for one minute~five hours at 500~700° C., being maintained for one minute~five hours at 750~1080° C., and being cooled, in order. In this case, the thermal reduction treatment can be carried out at a heating rate of 5~30° C. per minute. And, hydrogen is mostly used for the reducing gas atmosphere. Instead, $NH_3$ is dissociated for cost reduction just to be used for the reducing gas atmosphere wherein the dissociated gases include nitrogen and hydrogen with a ratio of 1:3.

In another aspect of the present invention, a use of a tungsten-coated W—Cu composite powder, which has a structure that tungsten grains surround a copper particle, for powder injection molding is provided.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to the preferred embodiments of the present invention, examples of which are illustrated in the accompanying drawings.

A method of forming a W—Cu composite powder according to the present invention is explained in the following description.

First of all, a tungsten oxide ($WO_3$ or $WO_{2.9}$) powder and a copper oxide (CuO or $Cu_2O$) powder are weighed so that a W—Cu composite powder formed using the oxide powders as raw materials has a target weight ratio of W:Cu. In this case, each of the tungsten and copper oxide powders has general purity.

The weighed oxide powders are mixed and pulverized using turbular mixing or ball milling. In this case, for the process conditions of turbular mixing or ball milling, a revolution speed of a jar is preferably 50~500 rpm for one minute~fifty hours. Preferably, the jar is made of stainless steel and the ball is made of tungsten carbide (WC) or stainless steel.

Meanwhile, impurities may be introduced into oxide powders from the collision between the jar and ball at an initial stage of ball milling. In order to prevent the contamination by these impurities, ball milling as a pre-step is preferably carried out with a small quantity of the oxide powders so that a wall surface of the jar and a surface of the ball are coated with tungsten oxide and copper oxide. It is preferable to carry out ball milling without additives for the prevention of introducing the impurities. Yet, in cases, a small quantity of PCA (process controlling agent) such as stearic acid or paraffin wax can be added thereto.

The mixed-pulverized powders by turbular mixing or ball milling are reduced under a hydrogen atmosphere or a reducing gas environment including hydrogen. And, hydrogen is mostly used for the reducing gas atmosphere. Instead, $NH_3$ is dissociated for cost reduction just to be used for the reducing gas atmosphere wherein the dissociated gases include nitrogen and hydrogen with a ratio of 1:3.

Figure 1:
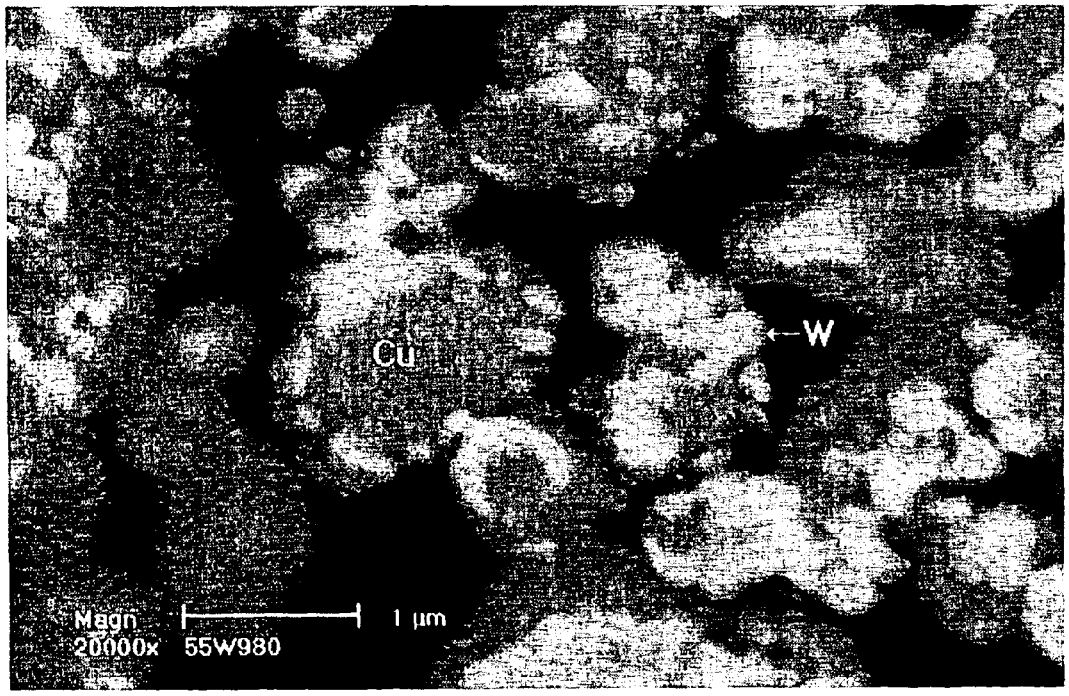
FIG. 1 illustrates a SEM picture of an inner structure of a tungsten-coated W—Cu composite powder according to the present invention.

Specifically, the thermal reduction treatment step for forming W—Cu composite powder with a structure that tungsten grains surround the copper particle is carried out on the mixed-pulverized powders through turbular mixing or ball milling by being maintained for one minute~five hours at 200~400° C., being maintained for one minute~five hours at 500~700° C., being maintained for one minute~five hours at 750~1080° C., and being cooled, in order. FIG. 1 illustrates a SEM picture of an inner structure of a tungsten-coated W—Cu composite powder according to the present invention. Referring to FIG. 1, it can be seen that dark-colored Cu is surrounded by bright and white tungsten.

The method of forming the W—Cu composite powder according to the present invention is applicable to a wide range of fields regardless of W—Cu composition. For instance, the method is applicable to 10W-90Cu, 55W-45Cu, 80W-20Cu, and the like.

Hereinafter, embodiments of the present invention are explained by referring to the attached drawings.

[First Embodiment]

Figure 2:
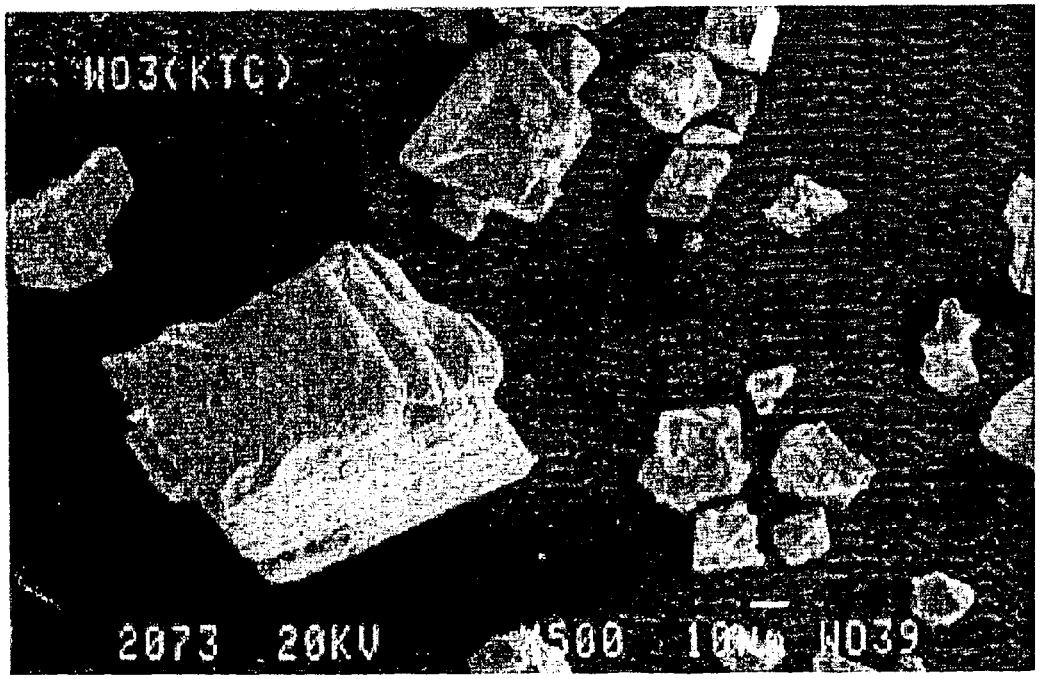
FIG. 2 illustrates a SEM picture of a tungsten oxide ($WO_3$) powder used for the present invention.
Figure 3:
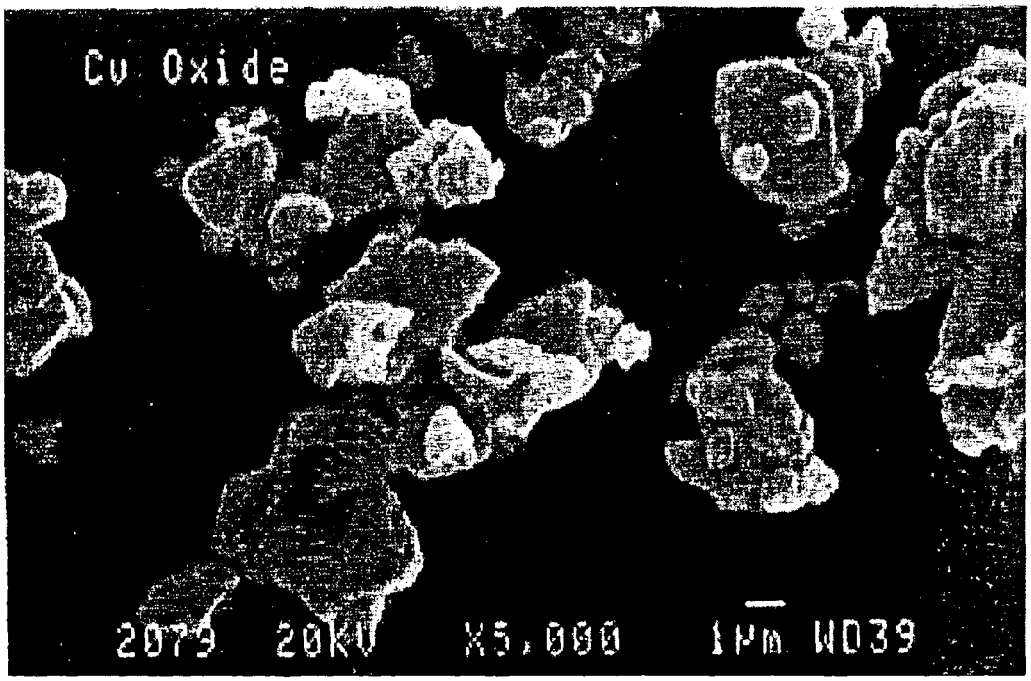
FIG. 3 illustrates a SEM picture of a copper oxide (CuO) powder used for the present invention.

A tungsten oxide ($WO_3$) powder with a grain size of 15~25 $\mu$m and a copper oxide (CuO) powder with a grain size of about 10 $\mu$m are weighed so as to have a W—Cu weight ratio of 55:45. The oxide powders are put in a stainless-steel jar. Ball milling is then carried out for 30 minutes at a revolution speed of 250 rpm using a tungsten carbide (WC) ball. In this case, a weight ratio between the used tungsten carbide ball and oxide powders is 32:1. FIG. 2 illustrates a SEM picture of a tungsten oxide ($WO_3$) powder used for the present invention and FIG. 3 illustrates a SEM picture of a copper oxide (CuO) powder used for the present invention.

Figure 4:
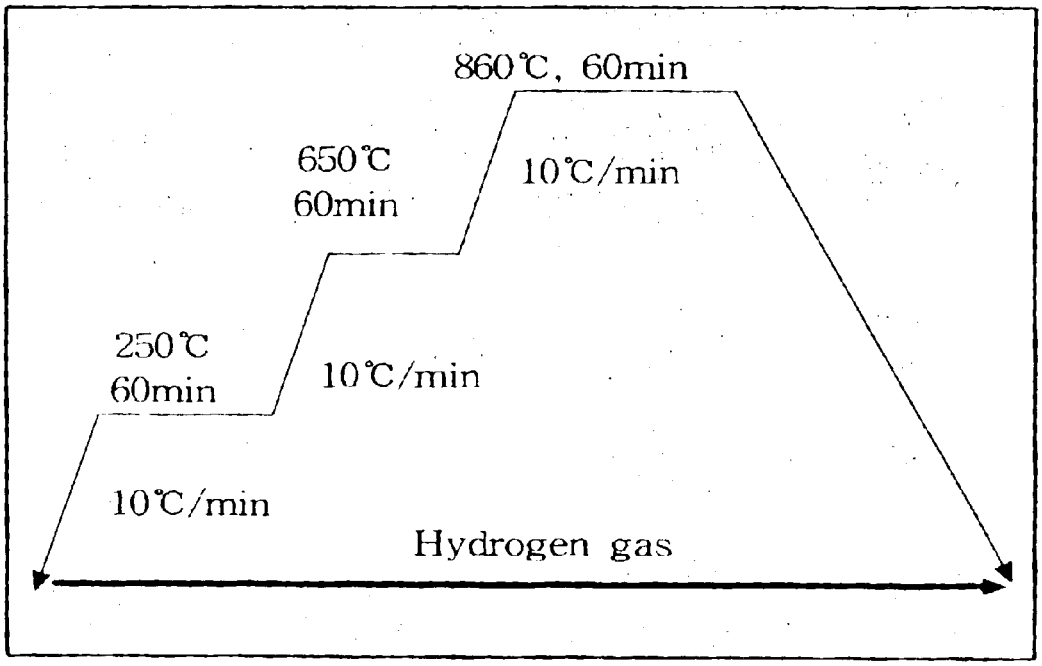
FIG. 4 illustrates a schematic diagram for a thermal reduction treatment of a tungsten-coated W—Cu composite powder according to the present invention.
Figure 5:
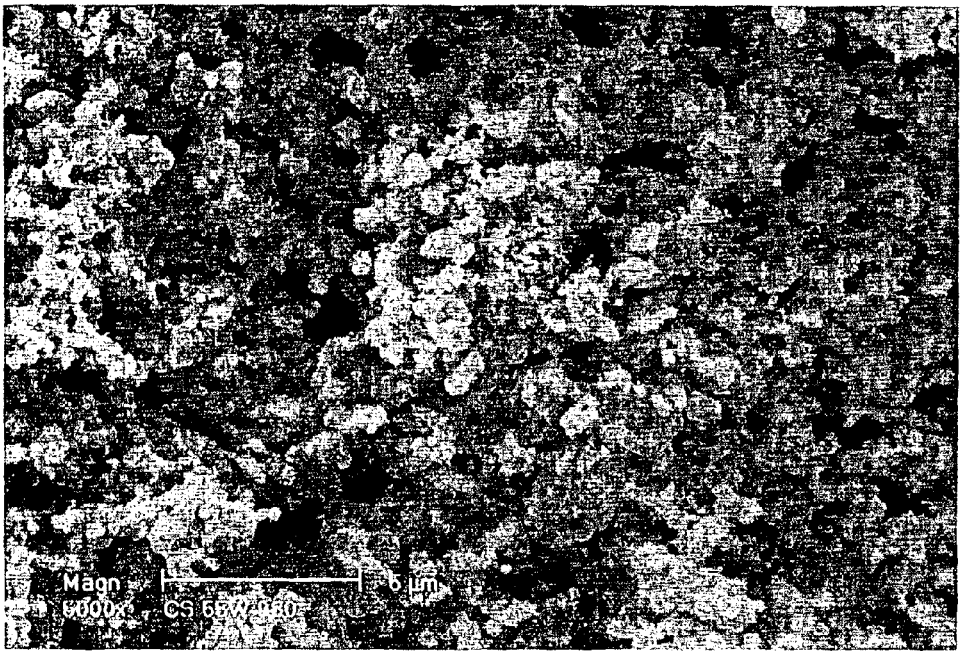
FIG. 5 illustrates a SEM picture of the morphology of a W—Cu composite powder formed by the present invention.
Figure 6:
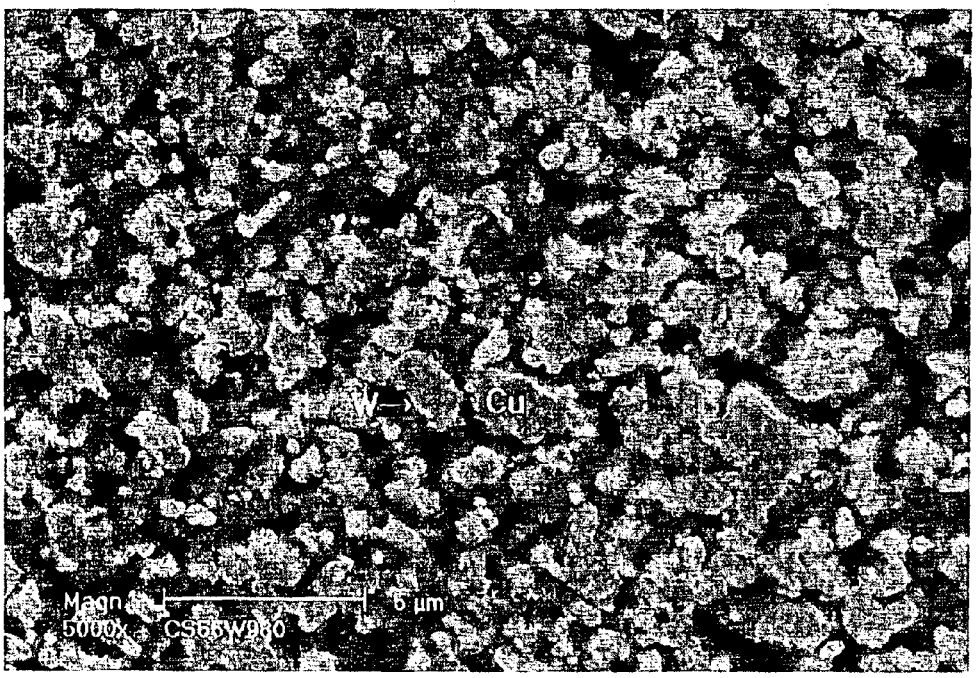
FIG. 6 illustrates a SEM picture of a cross-section of the Cu—W composite powder in FIG. 5.

The ball-milled oxide composite powders, as shown in FIG. 4, are maintained for one hour under a dry hydrogen atmosphere with the dew point of (−) 60° C. by increasing a temperature at a heating rate of 10° C. per minute up to 250° C., whereby the Cu particle is firstly reduced. And, the temperature is increased to maintain 650° C. for one hour, whereby nucleation of tungsten occurs on the reduced copper particle secondly. The temperature is increased again to maintain 860° C. for one hour, whereby tungsten grows thirdly so that tungsten is coated on the copper particle by reduction. Finally, cooling is carried out thereon, whereby a W—Cu composite powder is formed. FIG. 5 illustrates a SEM picture of the surface morphology of a W—Cu composite powder formed by the present invention and FIG. 6 illustrates a SEM picture of a cross-section of the Cu—W composite powder in FIG. 5. Referring to FIG. 5 and FIG. 6, unlike the related art, it can be observed that tungsten surrounds the copper particle by coating in the W—Cu composite powder according to the present invention.

[Second Embodiment]

Figure 7:
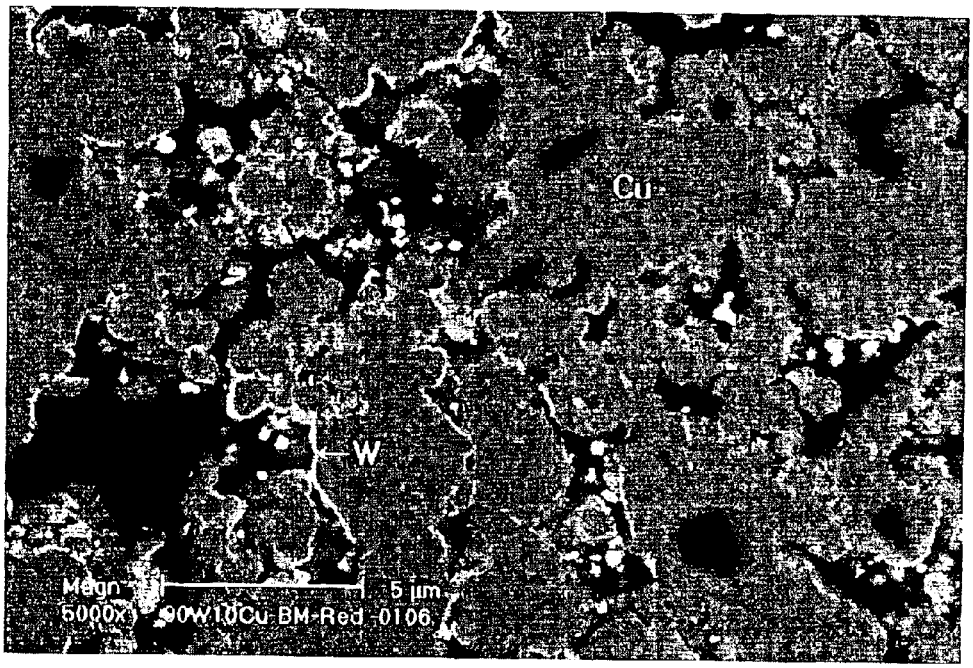
FIG. 7 illustrates a SEM picture of a cross-section of a W—Cu composite powder with a W—Cu weight ratio of 10:90.
Figure 8:
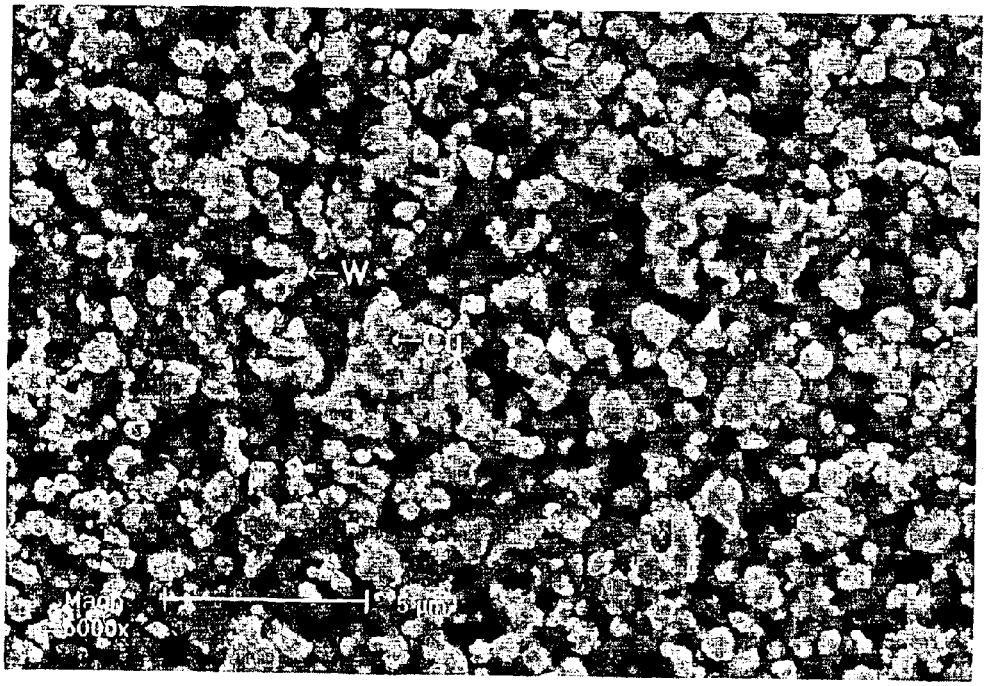
FIG. 8 illustrates a SEM picture of a cross-section of a W—Cu composite powder with a W—Cu weight ratio of 80:20.

In order to investigate how the formation of a tungsten-coated W—Cu composite powder according to the present invention varies if the composition conditions are changed, the same method of the first embodiment of the present invention is carried out but the weight ratio of W:Cu is varied in accordance with 10:90, and 80:20 to form the W—Cu composite powder. FIG. 7 illustrates a SEM picture of a cross-section of a W—Cu composite powder with a W—Cu weight ratio of 10:90 and FIG. 8 illustrates a SEM picture of a cross-section of a W—Cu composite powder with a W—Cu weight ratio of 80:20. Referring to FIG. 7 and FIG. 8, it can be seen that the copper particle is surrounded by tungsten by coating regardless of the composition.

This means that the method of forming the tungsten-coated W—Cu composite powder according to the present invention is applicable regardless of the weight ratio between W and Cu.

[Third Embodiment]

Figure 9:
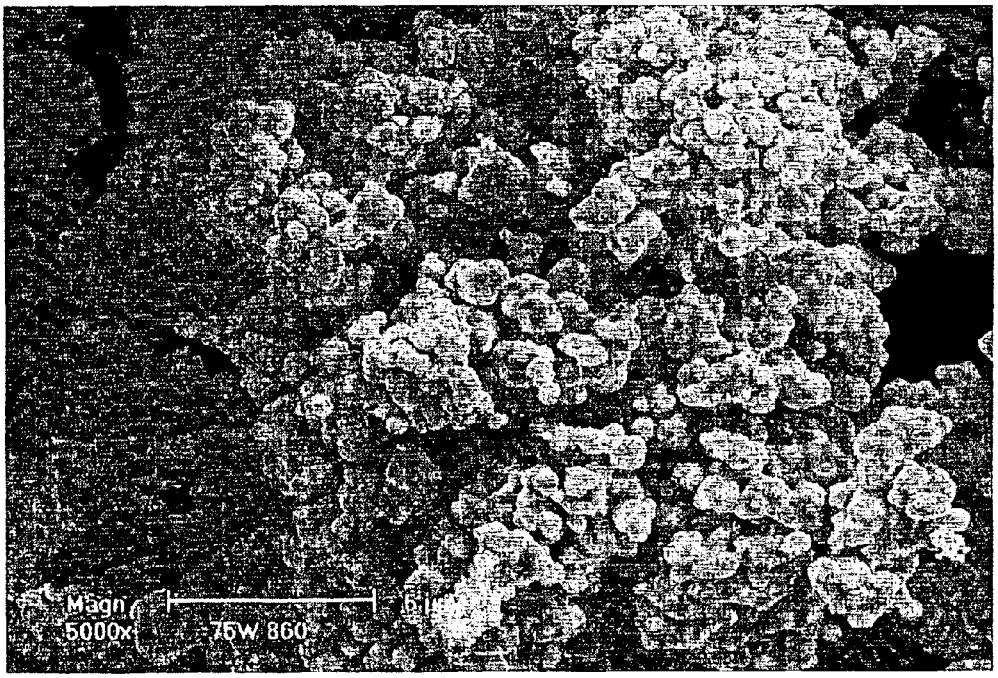
FIG. 9 illustrates a SEM picture of the surface morphology of a W—Cu composite powder reduced from a tubular-mixed powder for one hour.
Figure 10:
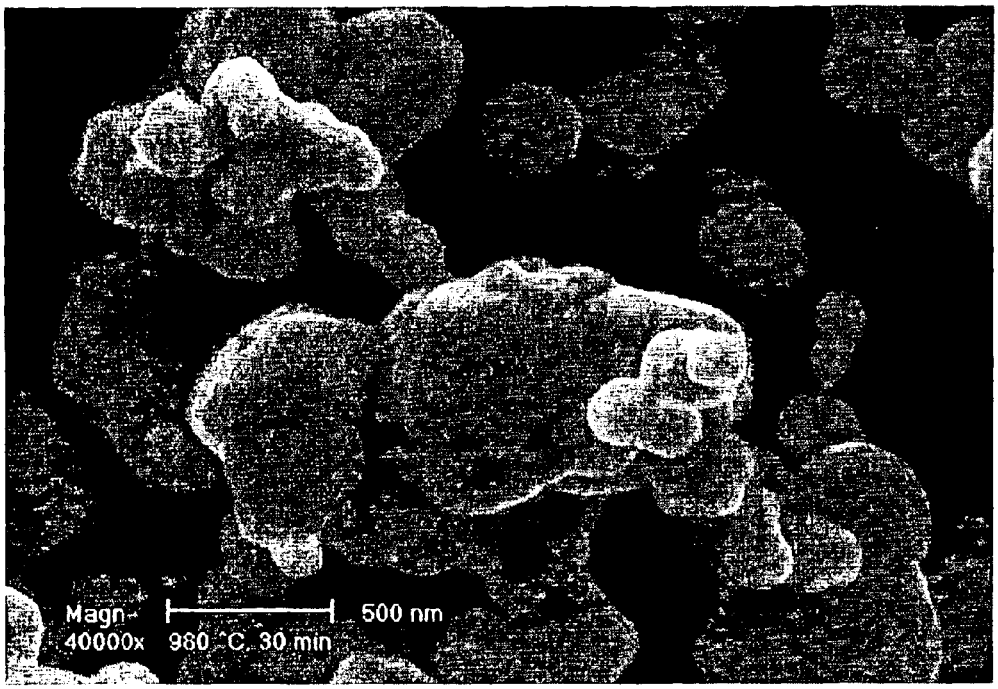
FIG. 10 illustrates a SEM picture of the surface morphology of a W—Cu composite powder reduced from a ball-milled powder for 30 minutes.
Figure 11:
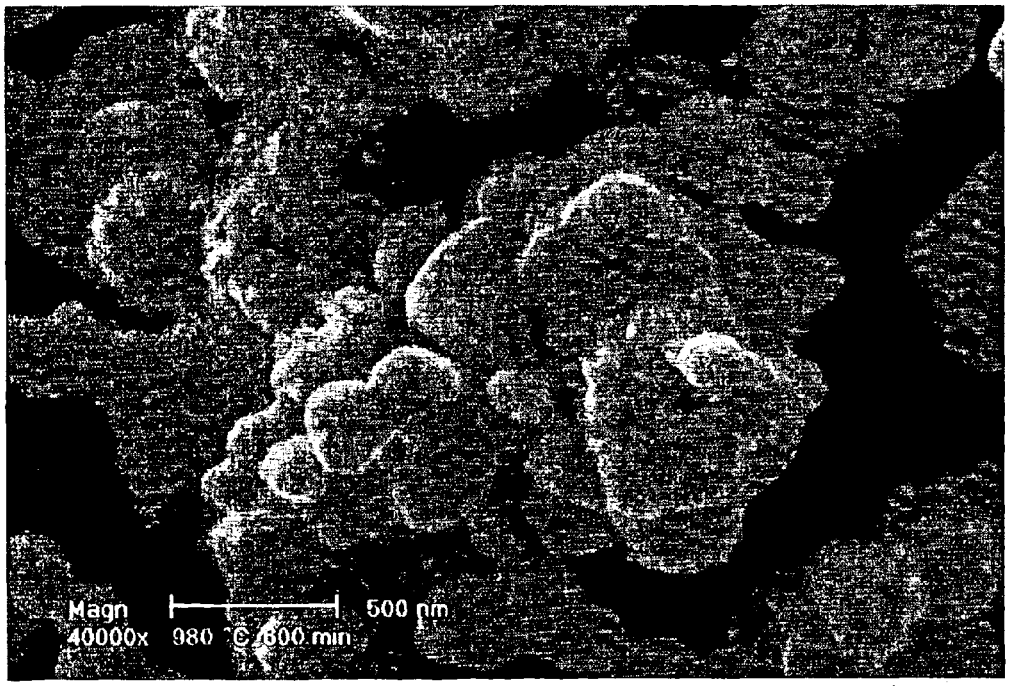
FIG. 11 illustrates a SEM picture of the surface morphology of a W—Cu composite powder reduced from a ball-milled powder for ten hours.
Figure 12:
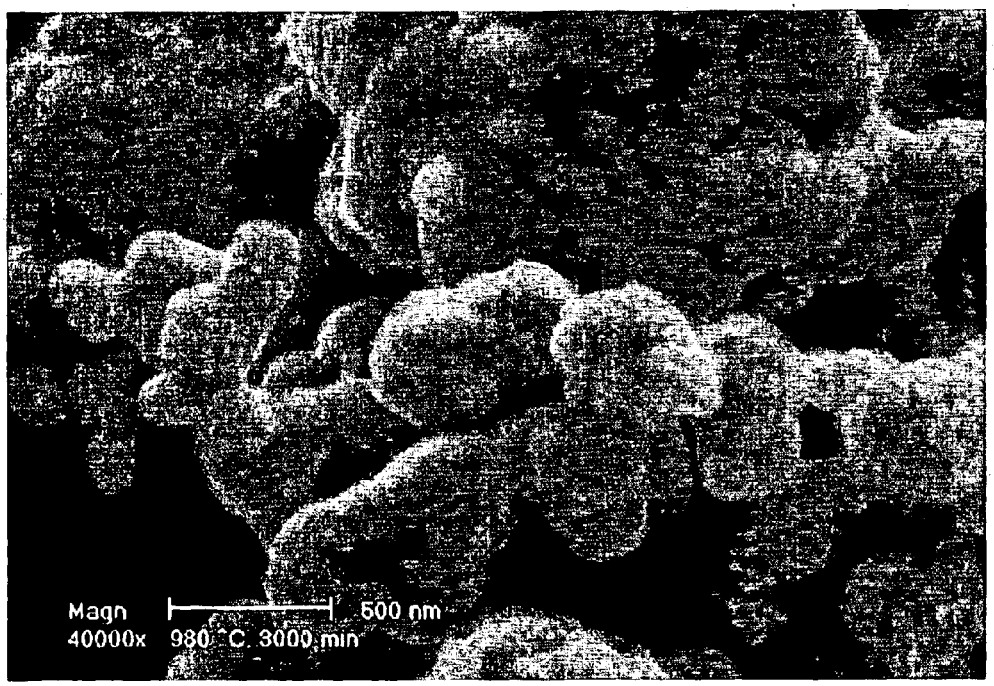
FIG. 12 illustrates a SEM picture of the surface morphology of a W—Cu composite powder reduced from a ball-milled powder for fifty hours.
Figure 13:
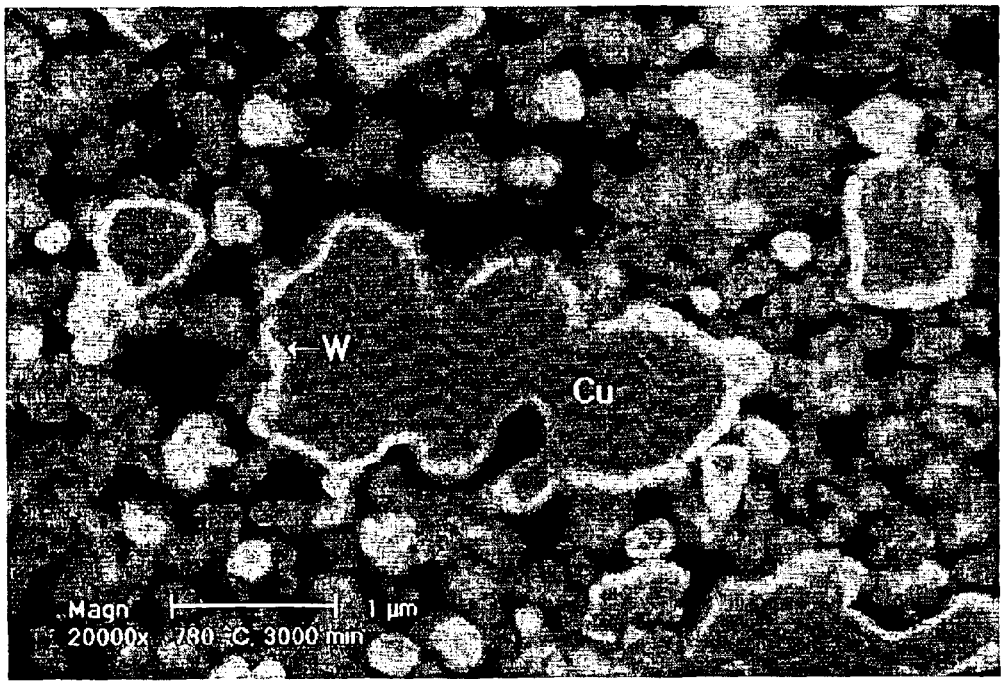
FIG. 13 illustrates a SEM picture of a cross-section of the Cu—W composite powder in FIG. 12.

In order to investigate how the formation of a tungsten-coated W—Cu composite powder according to the present invention varies if the mixing and pulverizing conditions are changed, the same method of the first embodiment of the present invention is carried out but turbular mixing is carried out for one hour instead of ball milling or the ball milling time is varied in accordance with 30 minutes, 10 hours, and 50 hours to form the W—Cu composite powder. FIG. 9 illustrates a SEM picture of the surface morphology of a W—Cu composite powder reduced from a turbular-mixed powder for one hour. Referring to FIG. 9, it can be seen that the copper particle is surrounded by tungsten coated thereon as similar as the case of the ball-milled powder. FIG. 10 illustrates a SEM picture of the surface morphology of a W—Cu composite powder reduced from a ball-milled powder for 30 minutes, FIG. 11 illustrates a SEM picture of the surface morphology of a W—Cu composite powder reduced from a ball-milled powder for ten hours, and FIG. 13 illustrates a SEM picture of a cross-section of the Cu—W composite powder in FIG. 12. Referring to FIG. 10, FIG. 11, and FIG. 13, it can be observed that the surface morphology of the W—Cu composite powder has no big difference in accordance with the ball milling time. Moreover, FIG. 13 illustrates a SEM picture of a cross-section of the Cu—W composite powder formed from the ball-milled powder for 50 hours. Referring to FIG. 13 similar to FIG. 6, it can be observed that the copper particle is surrounded by tungsten coated thereon.

This means that the method of forming the tungsten-coated W—Cu composite powder according to the present invention is applicable regardless of the turbular mixing or ball milling time.

[Fourth Embodiment]

Figure 14:
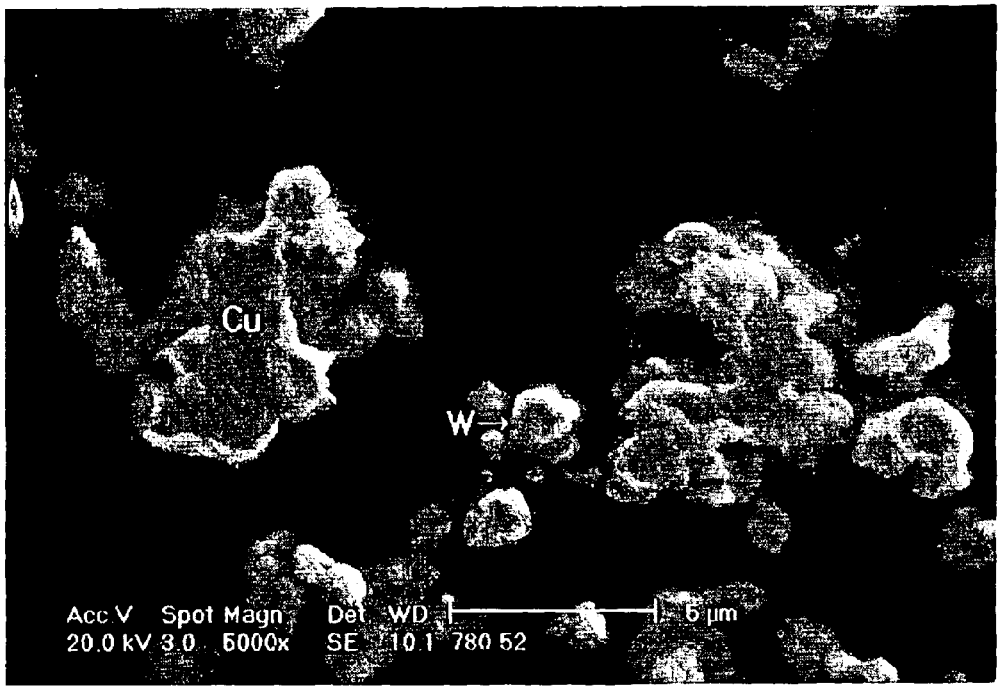
FIG. 14 illustrates a SEM picture of a cross-section of a Cu—W composite powder formed at a third reduction temperature of 780° C.
Figure 15:
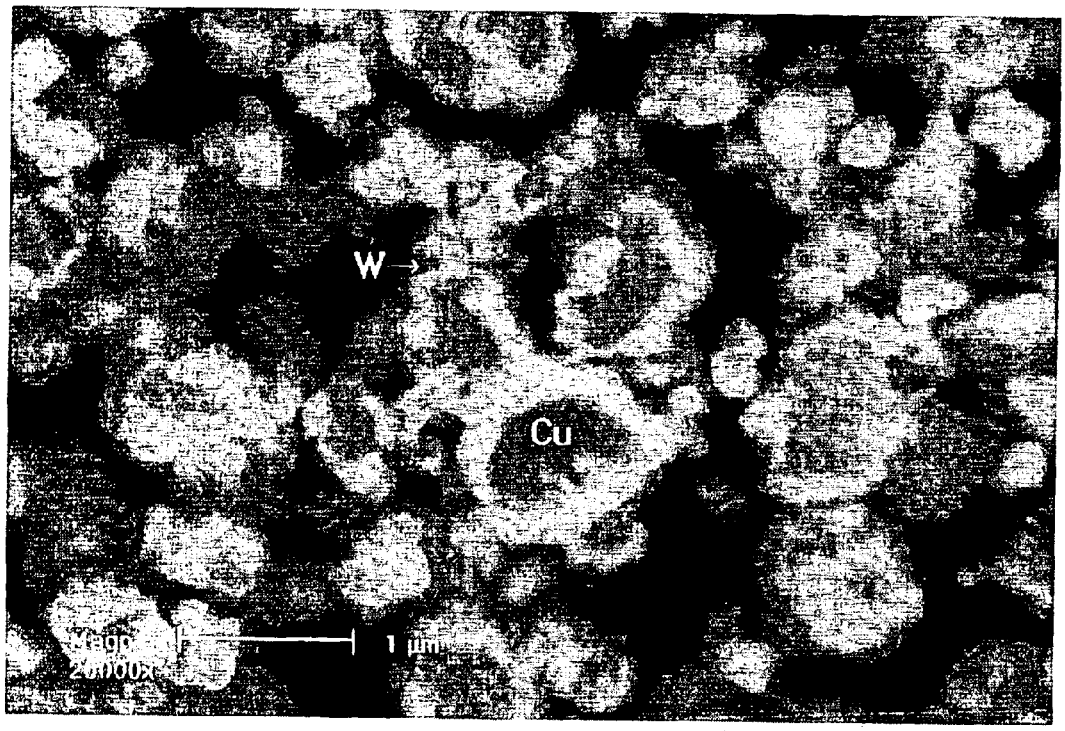
FIG. 15 illustrates a SEM picture of a cross-section of a Cu—W composite powder formed at a third reduction temperature of 1,060° C.

In order to investigate how the formation of a tungsten-coated W—Cu composite powder according to the present invention varies if a reduction temperature is changed, the same method of the first embodiment of the present invention is carried out but the third reduction temperature is changed into 780° C. and 1,060° C. so as to be maintained for one hour to form the W—Cu composite powder. In this case, 780° C. and 1060° C. are the temperature from which tungsten starts to grow actively and another temperature close to a melting temperature (1083° C.) of Cu. FIG. 14 illustrates a SEM picture of a cross-section of a Cu—W composite powder formed at a third reduction temperature of 780° C. and FIG. 15 illustrates a SEM picture of a cross-section of a Cu—W composite powder formed at a third reduction temperature of 1060° C. Referring to FIG. 14 and FIG. 15, the copper powder is surrounded by tungsten in the entire W—Cu composite powder even if the W—Cu composite powder differs in size in accordance with the third reduction temperature.

This means that the method of forming the tungsten-coated W—Cu composite powder according to the present invention is applicable to the third reduction temperature between 750° C.~1080° C.

The present invention includes the steps of mixing and pulverizing a tungsten oxide ($WO_3$ or $WO_{2.9}$) powder and a copper oxide (CuO or $Cu_2O$) powder using turbular mixing or ball milling and carrying out 3-step thermal reduction treatments on the mixed-pulverized oxide powders, thereby enabling to prevent the formation of intermediates and the intrusion of impurities.

Accordingly, the W—Cu composite powder, which has a structure that tungsten grains surround a copper particle, according to the present invention has a proper size as well as a round shape, thereby having a powder-feeding characteristic better than that of the related art. Therefore, the method and use according to the present invention provide excellent characteristics of compacting and powder injection molding.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A method of forming a tungsten-coated W—Cu composite powder, comprising the steps of:

mixing and pulverizing a tungsten oxide powder selected from the group consisting of $WO_3$ and $WO_{2.9}$ and a copper oxide powder selected from the group consisting of CuO and $Cu_2O$ using turbular mixing or ball milling; and carrying out a thermal reduction treatment on the mixed-pulverized oxide powders under a hydrogen atmosphere or a reducing gas environment including hydrogen, wherein the thermal reduction treatment is carried out by being maintained for 1 minute to 5 hours at 200 to 400° C., being maintained for 1 minute to five hours at 500 to 700° C., being maintained for 1 minute to 5 hours at 750 to 1080° C. and being cooled in that order.

2. The method of claim 1, wherein a weight ratio of W and Cu in the W—Cu composite powder is in the range of 10:90 to 90:10.

3. The method of claim 1, wherein the mixing/pulverizing step is carried out by turbular mixing or ball milling for 1 minute to 50 hours.

* * * * *